United States Patent [19]

Annello

[11] Patent Number: 4,711,031

[45] Date of Patent: Dec. 8, 1987

[54] ENVELOPE OPENER

[75] Inventor: Joan Annello, Landisville, N.J.

[73] Assignee: Paul Joseph Anello, Landisville, N.J.

[21] Appl. No.: 886,228

[22] Filed: Jul. 16, 1986

[51] Int. Cl.[4] ..... B67B 7/00

[52] U.S. Cl. ..... 30/294; 30/2; 30/DIG. 3

[58] Field of Search ..... 30/289, 290, 294, 34 A, 30/34 B, DIG. 3, 2

[56] References Cited

U.S. PATENT DOCUMENTS

| | | | |
|---|---|---|---|
| 673,375 | 5/1901 | Bayha | 30/DIG. 3 |
| 1,082,400 | 12/1913 | Burnite | 30/289 |
| 1,214,894 | 4/1917 | Camillieri | 30/289 |
| 1,216,889 | 2/1917 | Todd | 30/289 |
| 3,120,055 | 2/1964 | Baber | 30/289 |
| 3,142,119 | 7/1964 | O'Brien | 30/278 |
| 3,153,853 | 10/1964 | Lipton | 30/294 |
| 4,360,970 | 11/1982 | Ostroski et al. | 30/2 |
| 4,530,154 | 7/1985 | DiCarlo | 30/294 |

*Primary Examiner*—Douglas D. Watts

*Attorney, Agent, or Firm*—Wegner & Bretschneider

[57] ABSTRACT

A letter opener is disclosed for cutting off the edge of an envelope which has a deformable U-shaped body. A cutting blade is located in the upper wall of the body, and a hole positioned to receive the blade is located in the lower wall. An abutment attached to the lower wall serves both as a guiding surface for an envelope, and as a stopper to prevent the two walls from binding against the envelope when pressed together. The device is used by placing a corner of an envelope against the abutment, pressing the two walls together causing the blade to puncture the envelope, and drawing the device along the edge of the envelope to thereby slice off that edge of the envelope.

8 Claims, 6 Drawing Figures

ENVELOPE OPENER

BACKGROUND OF THE INVENTION

This invention relates to a letter opener, and more specifically to a letter opener which removes a small portion of an edge of an envelope.

In the field of letter openers, knife-like letter openers are known which slit the flap edge of an envelope. This kind of letter opener can be dangerous because the sharp point of the opener can cause injury through careless use.

Letter openers are also known which cut off a small portion along the length of one of the lateral edges of an envelope. These openers generally overcome the danger of potential injury involved with knife-like openers by enclosing the blade within a body of some sort.

For example, in the device of U.S. Pat. No. 1,214,894, a cutting edge is disposed in a deformable U-shaped body portion. In operation, a letter is inserted into the body against the back wall. The side walls are then pressed together, causing the blade to puncture the envelope and slide through an opening in the opposing wall. The letter is then slid parallel to the back wall, thus cutting off the edge of the envelope. This design has the disadvantage that when pressing the side walls together, they will press against the envelope, making it difficult to move the envelope with respect to the letter opener.

U.S. Pat. No. 1,082,400 discloses a similar device, which uses a guiding upright to guide the envelope, instead of the back wall of the U-shaped body. This device overcomes the above-mentioned disadvantage of the '894 patent by providing a soft filler into which the blade extends during use, which prevents the side walls from pressing against the envelope. However, even the soft filler will cause the blade to dull in time, making the opener unable to cut through an envelope. Furthermore, the guiding upright of U.S. Pat. No. 1,082,400 is too narrow to allow accurate guiding of the device along the envelope.

Envelope opening devices also are disclosed in U.S. Pat. Nos. 4,530,154, 4,360,970, 3,142,119, 3,153,853, and 673,375. These devices are all complex in design and have drawbacks similar to those outlined above.

OBJECTS OF THE INVENTION

It is an object of the invention to provide a letter opener which cuts off an extreme edge of an envelope, without the dangers associated with knife-like letter openers.

Another object is to provide such a letter opener which is easy to use, and allows easy movement of the cutting blade along the length of the envelope.

Still another object is to provide a letter opener which protects the tip of the cutting blade, thereby extending the life of the letter opener.

A still further object is to provide a letter opener which is simple in design and inexpensive to construct.

SUMMARY OF THE INVENTION

These and other objects of the present invention are achieved by a device comprising a U-shaped deformable body having a cutting blade on the upper inner surface thereof, and an abutment on the lower inner surface thereof.

The abutment preferably has an angled edge which serves as an abutment surface for the envelope. When the two sides of the U-shaped body are pressed together, the cutting blade enters the envelope at a predetermined distance from the abutment surface, corresponding to the width of the piece which is to be cut off the edge of the envelope. The top surface of the abutment serves to prevent the top and bottom sides of the body from pressing against the envelope.

The device also preferably has a thickened portion in the bottom of the body which has a hole defined therein designed to receive the cutting blade when the body is pressed together, as well as indicia means on the outside of the upper body wall which indicates the manner in which the device is to be held.

BRIEF DESCRIPTION OF THE DRAWINGS

The invention can be better understood with reference to the preferred embodiment which is described hereafter with reference to the drawings, in which.

DESCRIPTION OF THE PREFERRED EMBODIMENT

Figure 1:
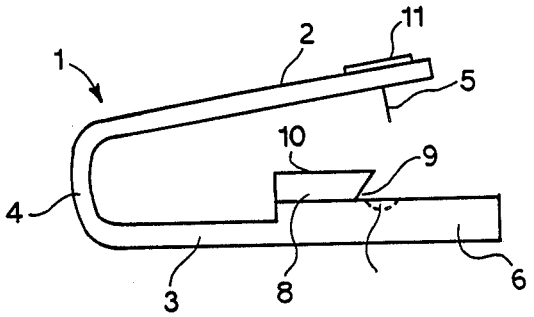
FIG. 1 is a side view of the letter opener of the present invention.

Referring to FIGS. 1–5, there is shown a letter opener having a body portion 1 having a generally U-shaped longitudinal cross-section, which is made up of top wall 2, bottom wall 3, and end wall 4. The top wall and bottom wall are capable of movement toward each other, and preferably are capable of resilient return to the original position upon release.

The top wall 2 has a small, very thin cutting blade 5 attached to the inner surface of the top wall, preferably in the shape of a downwardly pointing triangle. The blade is preferably glued into a small slit in the upper wall, but can be attached in any conventional manner. The blade preferably is pointed, so that an envelope to be opened is easily punctured by the blade.

The bottom wall 3 has an abutment 8 which serves as a guide for an envelope 12. The abutment 8 has an abutment face 9 which is preferably angled inwardly to help keep the edge of the envelope confined to the abutment. An angle of about 30° from vertical is useful. As the angle from vertical increases, so does the amount of envelope sliced off by the blade. Thus, the angle should not be too far from vertical. The abutment 8 also has a top surface 9 which acts as a stop for the top wall 2 as it is pressed toward the bottom wall 3. Thus, when the top and bottom walls are pressed together, as in FIG. 2, a small space between the top and bottom walls allows free movement of an envelope 12 within the body of the letter opener. The thickness of the abutment 8 is less than the length of the cutting blade (i.e., the distance of the blade extends downwards from the top wall), so that when the walls are pressed together, the blade can cut completely through the envelope. The abutment and blade may be positioned on the same wall, but this would make positioning of the envelope somewhat more difficult.

Figure 2:
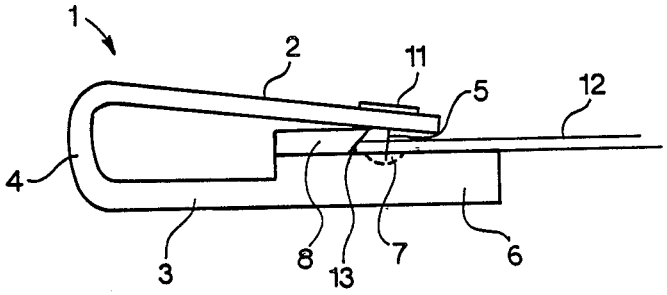
FIG. 2 is a side view showing the position of the letter opener when in use.
Figure 3:
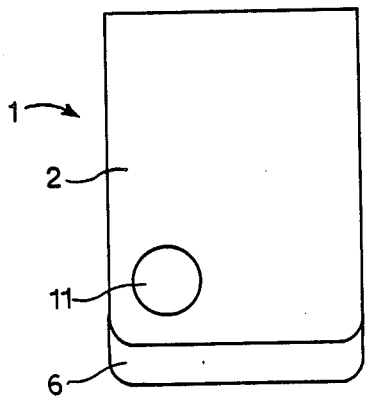
FIG. 3 is a top view of the letter opener.
Figure 4:
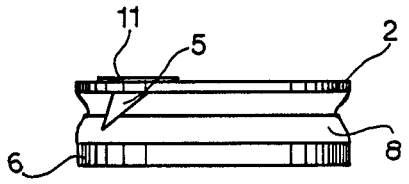
FIG. 4 is a front view thereof.
Figure 5:
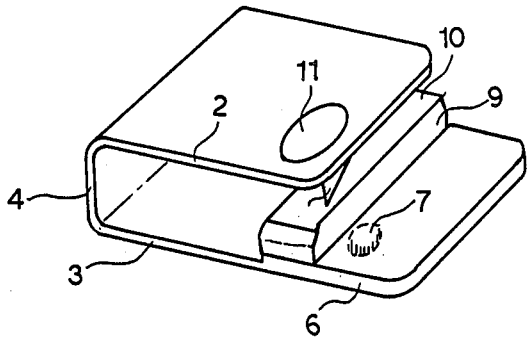
FIG. 5 is a perspective view of the preferred embodiment of the letter opener.

The bottom wall 3 may be provided with a small hole 7 which is directly below the cutting blade 5. The hole 7 is preferably deeper than the difference between the length of the cutting blade 5 and the thickness of the abutment 8, so that the blade can enter the hole 7 without touching the bottom wall 3. When the top and bottom walls are pushed together, as can be seen in FIG. 2, the cutting blade 5 enters the hole 7, thereby ensuring that the blade completely cuts through the envelope 12 and that the tip of the blade does not dull through contact with any hard surfaces. It is desirable to form the hole in a thickened end portion 6 of the bottom wall. The hole optionally could extend completely through the bottom wall, in which case the thickness of the abutment and the bottom wall should be greater than the length of the blade.

As can be seen in FIG. 2, when the top and bottom walls of the body 1 are pressed together, the cutting blade 5 is located at a pre-determined distance away from the abutment 8, which corresponds to the width of a slice 14 (FIG. 6) of the envelope 12 which is to be cut off. The width of the slice 14 is preferably small enough to ensure that none of the contents of the envelope are accidentally cut.

Finally, the letter opener preferably has indicia means 11 on the upper surface of the top wall 2, directly opposed to the base of the blade, which indicates to the user where the opener is held during use.

The body 1 of the envelope opener may be made out of a thin sheet of plastic, such as that sold under the name of KYDEX®, although many other materials, such as metal or other plastics, will suffice. The body is cut to shape and then heated and folded into a U-shape. The abutment 8 and the thickened end portion 6 are preferably made of the same material as the body and glued onto the body, although other methods of joining or even integral molding are possible. The cutting blade 5 can be made of any known cutting material, and is preferably glued into a small slit in the upper wall 2.

Figure 6:
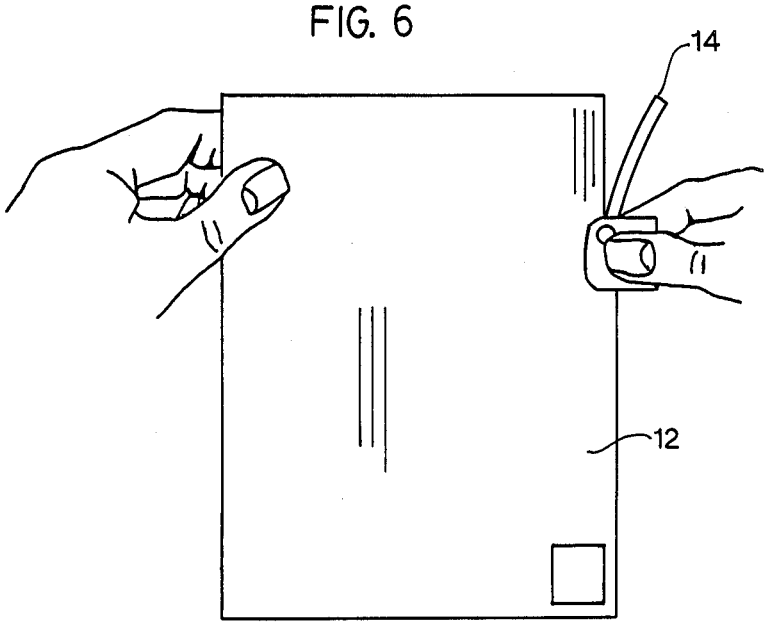
FIG. 6 is a perspective view showing the letter opener of the present invention in use.

The letter opener of the preferred embodiment is used as follows:

The user holds an envelope in their left hand with the edge to be cut facing right. The opener is held as shown in FIG. 6 with the right thumb over the indicia means 11. The corner of the envelope is then inserted into the open end of the U-shaped body 1 against the abutment face 9. The upper wall 2 and lower wall 3 are then pressed together, causing the cutting blade 5 to penetrate through the envelope 12 and into the hole 7. The letter opener is then drawn downwardly (or the envelope upwardly) parallel to the abutment face 9, thereby cutting the slice 14 off the edge of the envelope.

Many modifications of the present invention are possible in light of the above teaching. For example, the U-shaped body can be made with rounded or square ends, and the shapes and dimensions of the various parts can be modified, without departing from the spirit and scope of the present invention. Although a detailed description has been provided above, the present invention is not limited thereto, but rather is defined by the following claims.

What is claimed is:

1. A device for opening an envelope, comprising:

a body of generally U-shaped longitudinal cross-section, comprising first and second walls each having first and second ends, said first and second walls being joined at the first ends, the second ends being free, said second ends being capable of movement toward each other, said walls each comprising a first surface facing toward the other wall and a second surface facing away from the other wall;

a cutting blade fixedly attached to the first surface of said first wall and projecting therefrom;

a thickened end portion formed on the first surface of said second wall and extending toward the second end of the second wall, said thickened end portion forming a flat guiding surface for the envelope;

an abutment means attached to the thickened end portion, comprising a substantially planar abutment edge which forms an acute angle with respect to the guiding surface and which guides the envelope therealong, and an upper surface for engaging the first wall when said first and second walls are pressed toward each other, said blade having a length which is greater than the thickness of the abutment means;

a hole formed in the thickened end portion which is located to receive the cutting blade when the first and second walls are pressed toward each other, said hole having a depth which is greater than the difference between the distance the blade projects from the first wall and the thickness of the abutment means;

wherein when said first and second walls are pressed together, the cutting blade and abutment edge are spaced from each other a pre-determined distance apart corresponding to the width of a slice to be cut off the envelope, the location and dimensions of the hole being such that the blade does not contact the perimeter of the hole.

2. A device as claimed in claim 1, wherein the thickened end portion does not extend to the first end of the second wall.

3. A device as claimed in claim 2, wherein the thickened end portion terminates approximately half way between the first and second ends of the second wall.

4. A device as claimed in claim 1, wherein said cutting blade is triangularly shaped with one side fixedly attached to said first wall, and one corner projecting toward said second wall.

5. A device for opening an envelope, comprising:

a body of generally U-shaped longitudinal cross-section, comprising first and second walls each having first and second ends, said first and second wall being joined at the first ends, the second ends being free, said second ends being capable of movement toward each other, said walls each comprising a first surface facing toward the other wall and a second surface facing away from the other wall;

a cutting blade fixedly attached to the first surface of said first wall and projecting therefrom;

a thickened end portion formed on the first surface of said second wall and extending toward the second end of the second wall, said thickened end portion forming a flat guiding surface for the envelope;

an abutment means attached to the thickened end portion, comprising a substantially planar abutment edge which forms an acute angle with respect to the guiding surface and which guides the envelope therealong, and an upper surface for engaging the first wall when said first and second walls are pressed toward each other, said blade having a length which is greater than the thickness of the abutment means;

a hole formed in the thickened end portion which is located to receive the cutting blade when the first and second walls are pressed toward each other, said hole having a depth which is greater than the difference between the distance the blade projects from the first wall and the thickness of the abutment means;

indicia means comprising a raised stamp attached to the second surface of said first wall, at a location essentially corresponding to the location of the blade on the first surface of the first wall;

wherein when said first and second walls are pressed together, the cutting blade and abutment edge are spaced from each other a pre-determined distance apart corresponding to the width of a slice to be cut off the envelope, the location and dimensions of the hole being such that the blade does not contact the perimeter of the hole.

6. A device as claimed in claim 5, wherein the thickened end portion does not extend to the first end of the second wall.

7. A device as claimed in claim 6, wherein the thickened end portion terminates approximately half way between the first and second ends of the second wall.

8. A device as claimed in claim 5, wherein said cutting blade is triangularly shaped with one side fixedly attached to said first wall, and one corner projecting toward said second wall.

* * * * *

UNITED STATES PATENT AND TRADEMARK OFFICE

CERTIFICATE OF CORRECTION

PATENT NO. : 4,711,031

DATED : December 8, 1987

INVENTOR(S) : Joan ANNELLO

It is certified that error appears in the above-identified patent and that said Letters Patent is hereby corrected as shown below:

On the first page, in the "Assignee," please change "Anello" to --Annello--.

Signed and Sealed this

Tenth Day of May, 1988

*Attest:*

*Attesting Officer*

DONALD J. QUIGG

*Commissioner of Patents and Trademarks*